US007389669B2

(12) United States Patent
Badlani et al.

(10) Patent No.: US 7,389,669 B2
(45) Date of Patent: Jun. 24, 2008

(54) MECHANICAL STRESS IMPROVEMENT PROCESS

(75) Inventors: Manu Badlani, Fox Chapel, PA (US); Brian Scott Beley, Monroeville, PA (US); Thomas A. Damico, Murrysville, PA (US)

(73) Assignee: AEA Technology Engineering Services, Inc., Pittsburgh, PA (US)

( * ) Notice: Subject to any disclaimer, the term of this patent is extended or adjusted under 35 U.S.C. 154(b) by 0 days.

(21) Appl. No.: 11/559,177

(22) Filed: Nov. 13, 2006

(65) Prior Publication Data

US 2008/0110229 A1 May 15, 2008

(51) Int. Cl.
*B21D 3/00* (2006.01)

(52) U.S. Cl. ..... 72/367.1; 72/308; 228/184; 285/288.8; 376/305

(58) Field of Classification Search ..... 72/292, 72/304, 308, 342.94, 367.1, 370.13; 228/155, 228/184, 44.3; 285/288.1, 288.8; 376/305; 219/607, 609

See application file for complete search history.

(56) References Cited

U.S. PATENT DOCUMENTS 4,318,966 A * 3/1982 Fawcett ..... 428/683
4,491,001 A * 1/1985 Yoshida et al. ..... 72/76
4,612,071 A 9/1986 O'Donnell et al.
4,683,014 A 7/1987 Porowski et al.
5,278,878 A * 1/1994 Porowski ..... 376/260

FOREIGN PATENT DOCUMENTS

JP 5-154683 * 6/1993

* cited by examiner

*Primary Examiner*—Edward Tolan
(74) *Attorney, Agent, or Firm*—Daniel C. Abeles; Eckert Seamans Cherin & Mellott, LLC

(57) ABSTRACT

A process for reducing residual tensile stresses in high nickel-chromium alloy nozzle safe-end welds of pressurized water reactor nuclear pressure vessels such as are found at the reactor vessel inlet and outlet nozzles and the pressurizes surge, spray, safety and relief nozzles. The process involves the application of radial compression on the outside surface of the nozzle's safe-end and/or connecting coolant piping, to reduce the outside diameter at the mid-point of the piping element to which the load is applied to between about 0.2% and about 3%. The radially compressive load applied by this process is imparted using a mechanical device that can be employed at the vessel manufacturer's facility or at a nuclear power plant after welding of the nozzle safe-end to the coolant piping or before either after plant commissioning of operation.

9 Claims, 7 Drawing Sheets

MECHANICAL STRESS IMPROVEMENT PROCESS

BACKGROUND OF THE INVENTION

1. Field of the Invention

This invention relates generally to a process for removing the residual tensile welding stresses in the inner layer of a weld metal and heat affected zone that joins two dissimilar metals and more particularly for removing tensile residual stresses in a circumferential weld that joins a pressurized water reactor pressure vessel nozzle and a safe-end that are butt-welded to each other end to end.

2. Description of the Prior Art

When piping is butt-welded together by means of a circumferential weld, significant residual tensile welding stresses are produced in the weld metal and in the heat-affected zone of the piping. These tensile stresses tend to enhance stress corrosion cracking in the weld region and the resulting crack propagation in the weld metal and in the heat-affected zone of such piping.

Stress corrosion cracking in stainless steal piping has been a serious drawback in boiling water reactor (BWR) plants in the United States and elsewhere in the world. Mitigating remedies have included hydrogen addition to the water flowing through the pipes, the use of the improved welding techniques and the use of better materials in the preparation of the steel piping. However, the occurrence of cracks have not been fully eliminated in the BWR plants.

Induction heating stress improvement (IHSI) is one method currently being used to improve residual welding stresses in piping welds. IHSI is a thermal process requiring precise time and temperature controls. While suitable for simple pipe to pipe welds it has potential concerns of successful applications to multi-metal nozzle to safe-end welds with complex configurations.

O'Donnell et al. U.S. Pat. No. 4,612,071 describes a mechanical stress improvement process for reducing the tensile residual welding stresses in the weld metal, heat-affected zone and in the adjacent base metal of stainless steel piping for BWRs where the piping is butt-welded together end to end with a circumferential weld. The process introduces compressive stresses in the weld metal, heat-affected zone and adjacent base metal by permanently reducing the diameter of the adjacent pipe(s).

The permanent reduction in diameter required by the O'Donell et al. process has to be at least 0.2% but less than 1% and preferably in the range of about 0.2% to about 0.8%. The compressive stresses were imposed on the weld metal, heat-affected zone and on the adjacent base metal using split steel rings that were forced together by peripheral flange bolts.

U.S. Pat. No. 4, 683,014 describes an improvement in the mechanical stress improvement process wherein the radial load is applied inwardly on a section of at least one of the piping elements away from the weld such that the distance from the midplane of the section of the piping element upon which the radial load is applied to the weld midplane is equal to about 2 to about 12 times the thickness of the piping element upon which the radial load is applied. The distance from the edge of the section of the piping element upon which the radial load is applied that is adjacent to the weld to the weld midplane is at least equal to about one-half of the thickness of the piping element upon which the load is applied. The amount of radial load applied is sufficient to permanently reduce the outside diameter at the midplane of this section of the piping element in the range of about 0.2% to about 2.0%.

Stress corrosion cracking has more recently been observed in the nozzle ends of pressurized water reactor nuclear steam supply system primary components, such as the reactor vessel inlet and outlet nozzles and the pressurizer surge line, spray, safety and relief nozzles. While a significant cause of the weld cracks in pressurized water reactors may be similar to that identified in BWRs i.e. post weld residual tensile stresses, the geometry of the nozzles and safe-ends are much different than are found in boiling water reactors. The nozzles on the boiling and pressurized water reactor pressure vessels are forged from low alloy carbon steel and are connected to the stainless steel coolant piping through a high nickel-chromium alloy intermediate coupling known as a safe-end. The pressure vessel nozzle and the safe-end are butt-welded together, end to end, with a high nickel-chromium alloy weld material. The thicknesses of the PWR safe-ends are much greater and their lengths generally shorter than the BWR safe-ends. The geometry of the nozzles and the short lengths of the thicker safe-ends do not readily lend themselves to the mechanical stress improvement process taught by either U.S. Pat. Nos. 4,683,014 and 4,612,071 for relieving the stresses on the nozzle to safe-end weld.

Application of structural weld overlay reinforcement on the external surface of the nozzle-end and weldment is being considered as a remedy against initiated or potential primary water stress corrosion cracking. However, the process would have a high cost and radiation exposure and require an extended outage time.

Removal of an inside layer of the susceptible weld material and deposition of a less susceptible high nickel chromium alloy weld metal is offered either as a repair of existing cracks or as a preventative measure to mitigate primary water stress corrosion cracking potential. This process requires access to the inside of the pressure vessel nozzle in a dry condition. This repair process will also have a high cost and radiation exposure and requires an extended outage time.

Shot peening is a process that produces a thin surface layer where the material is under compression. The presence of the surface compression would prevent the initiation of primary water stress corrosion cracking. It is evident however, that any such induced compression would not stop the propagation of existing cracks that extend beyond the depth of the compressive layer. Also the long-term behavior of the thin compressive layer following operational thermal cycles is not known.

Accordingly, a new weld repair process is desired that can be applied to relieve the stresses in the nozzle to safe-end welds in a pressurized water reactor steam supply system.

Furthermore, such a process is desired that will relieve the tensile stresses on the inner surface of such welds and permanently introduce compressive forces in such welds, which extend outward from the inner weld surface.

Additionally, such a process is desired that can be performed relatively quickly, during a plant outage to minimize radiation exposure.

SUMMARY OF THE INVENTION

These and other objects are achieved by the reduction of the tensile residual weld stresses located in the high-nickel weld joints between the quenched and tempered low-alloy steel forged nozzles and the austenitic stainless steel safe-ends. The residual stress reduction is achieved by applying radial compressive forces either on the safe-end external surface close to the high nickel-chromium alloy weld joint, or on the connecting coolant piping external surface close to the stainless steel weld joint, or, preferably, simultaneously on both the safe-end and coolant piping external surface close to both weld joints by spanning the stainless steel weld joint.

In one preferred embodiment the radial load applied is sufficient to obtain a permanent reduction in the outside diameter at a midplane where the load is applied in a range of about 0.2% to about 3.0% and preferably 0.6% to about 2.5%. The resulting compressive stresses are maintained from the inside until approximately 50 percent of the weld thickness, where the compressive stresses gradually change to tensile stresses, reaching the maximum level on the nozzle external surface; an area not susceptible to primary water stress corrosion cracking. The replacement of tensile stresses as provided herein, in the inner surface of the high nickel-chromium alloy welds between the low alloy nozzles and the austenitic stainless steel transition rings or safe-ends of the pressurized water reactor pressure vessel inlet and outlet nozzles and in pressurizer surge, spray, safety and relief nozzles, will mitigate and prevent the potential occurrence of primary water stress corrosion cracking in the nozzle end welds.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENTS

Pressurized water reactor nuclear steam supply system nozzles in the nuclear reactor pressure vessel upper shell course and in the pressurizer vessel upper and lower heads are normally manufactured with quenched and tempered low alloy steel forgings. Prior to the ASME code required post-weld heat treatment, the nozzle end is buttered with a weld deposit of high nickel-chromium coated electrodes or bare wire (commercially known respectively as Inconel 182 or 82). The minimum thickness of the buttering once machined is typically 0.125" (0.3175 centimeters).

After post-weld heat treatment of the pressure vessel component and the machining of the buttered nozzle end to obtain a suitable bevel, the buttered nozzle end is normally welded to an austenitic stainless steel transition piece normally referred to as the nozzle safe-end. The nozzle safe-ends are welded to the reactor vessel and pressurizer nozzles by the pressure vessel manufacturer after post-weld heat treatment, but prior to the ASME code required hydraulic pressure test of the vessel, to facilitate the subsequent field welding of the nozzle-end to the austenitic stainless steel coolant piping.

The welding between the nozzle-end buttered bevel and the safe-end bevel is normally performed using high nickel chromium coated electrodes or bare wire (commercially known respectively as Inconel 182 or 82). This latter high nickel-chromium alloy weldment is not post-weld heat-treated and as such maintains a high level of tensile residual weld stresses in the inner part of the weld joint. These tensile residual weld stresses have been found to be a major contributor to the appearance of primary water stress corrosion cracks in the nozzle ends inside surface of reactor vessels and pressurizer vessels after they have been in operation for a few years.

The cracks associated with the primary water stress corrosion cracking phenomenon are either axial or circumferential, or a combination of axial and circumferential and may extend and grow through the thickness of the nozzle end, breaking the pressure barrier and allowing contaminated primary coolant water to leak out to the containment building.

Figure 1:
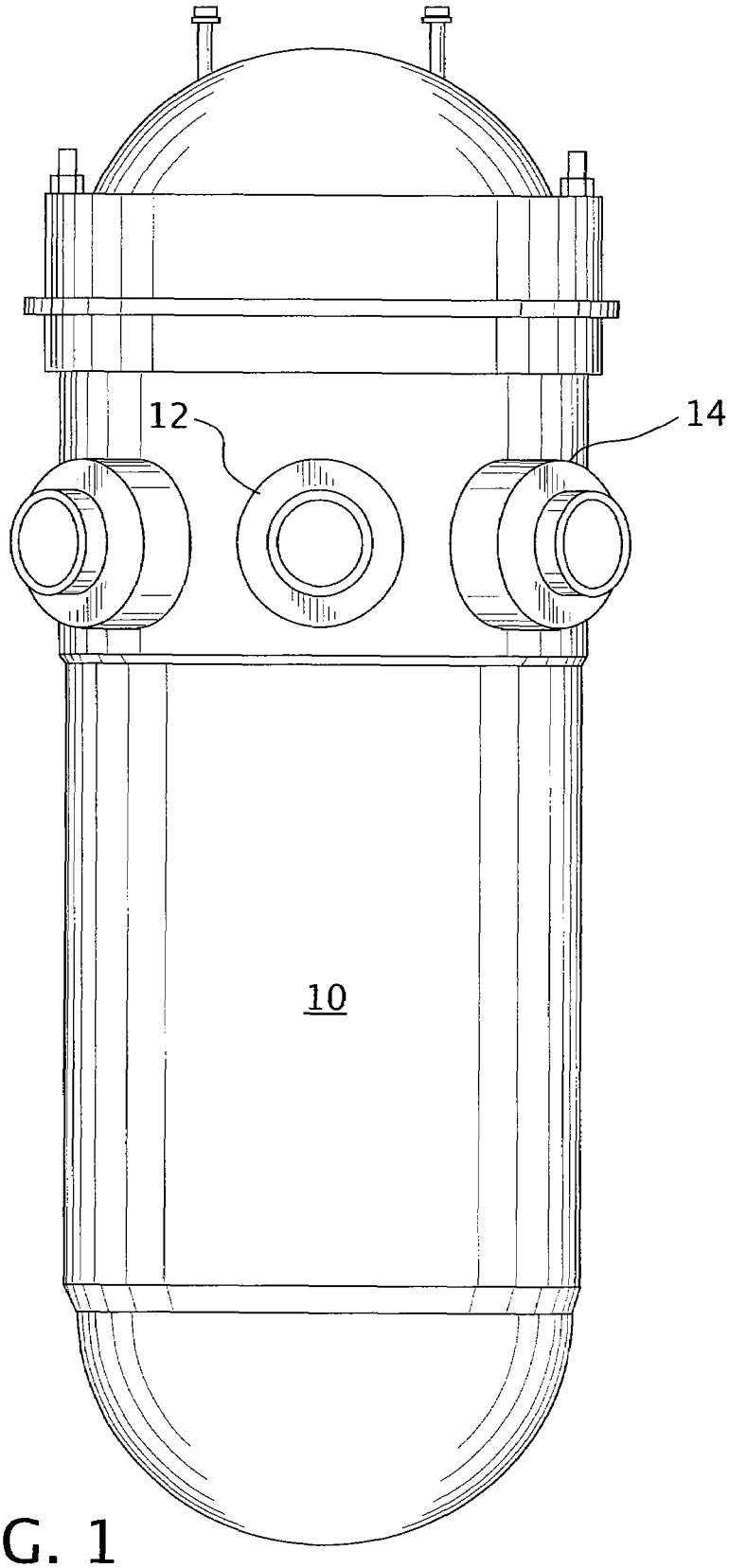
FIG. 1 is a planned view of a pressurized water reactor pressure vessel, showing the inlet and outlet nozzles from which cooling water enters and exits the reactor pressure vessel.

Referring to FIG. 1 there is shown a typical pressurized water nuclear reactor vessel 10 provided with inlet nozzle 12 and outlet nozzles 14. Typically there is one inlet and one outlet nozzle for each of the heat removal coolant loops in a pressurized water nuclear steam supply system, which typically has anywhere from 1 to 4 such loops. The linear portion of the reactor vessel shell is formed from several courses of tempered low alloy steal ring forgings which are welded together end to end. The nozzles 12 and 14 are situated in the upper shell course.

Figure 2:
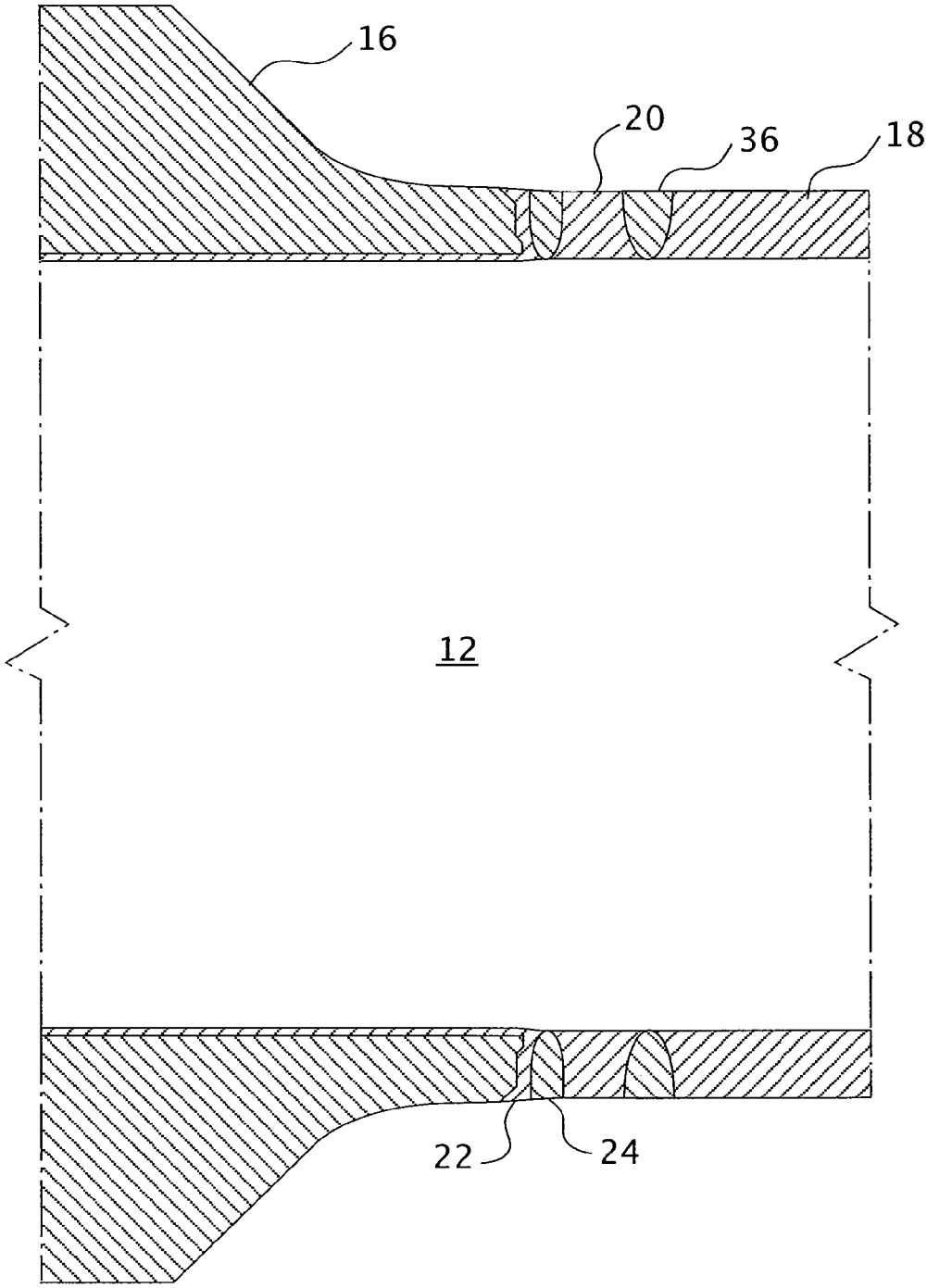
FIG. 2 is a cross-sectional view of a typical reactor vessel nozzle and high nickel-chromium alloy weld buttering welded to a forged austenitic stainless steel safe-end.

Referring to FIG. 2 there is illustrated a typical configuration for an inlet nozzle 12 though it should be appreciated that the outlet nozzle 14 configuration would look the same. These nozzles can be formed as an integral part of the reactor vessel nozzle belt ring forging or formed from separate forgings welded to the reactor vessel nozzle belt.

To facilitate the subsequent field welding operation between the reactor vessel inlet or outlet nozzle end 16 and the austenitic stainless steel piping 18, a stainless steel transition piece or safe-end 20 is welded by the reactor pressure vessel manufacturer to the low-alloy-steel nozzle forging end 16. The welding between the low-alloy-steel nozzle forging 16 and the stainless steel transition piece or safe-end 20 is made with a nickel-chromium alloy welding material in two steps. During the first step, the low alloy steel nozzle end forging 16 is buttered by depositing a minimum of two layers of high-nickel-alloy welding material 22 using either consumable coated electrodes or bare weld filler material such as weld wire.

Upon completion of the buttering operation, the nozzles are submitted, together with the reactor vessel to a post-weld heat treatment to remove residual weld stresses and temper the low-alloy-steel nozzle heat-affected zone.

The high nickel alloy buttered weld surface 22 is then machined to obtain a suitable weld chamfer geometry that is compatible with the matching weld chamfer of the austenitic stainless steel transition piece or safe-end 20. The minimum thickness of the as machine high nickel alloy weld buttering layers 22 is typically 0.125" (0.3175 centimeters).

During the next step the buttered nozzle end 22 is welded to the austenitic stainless steel transition ring or safe-end 20 normally with high-nickel-alloy electrodes or bare filler wire.

This last welded joint 24 is not submitted to a stress-relieving post-weld heat treatment and therefore the inner part of the nozzle end high nickel-chromium alloy weld, including the adjacent high nickel-chromium alloy buttering 22, is left with residual tensile stresses, whose level is normally equivalent to the yield strength of the as-deposited high nickel-chromium alloy weld metal 24. The presence of tensile residual weld stresses in the inner part of the reactor vessel and the pressurizer surge, spray, safety and relief nozzle bi-metallic joints, which have been welded using high nickel-chromium alloy weld materials, have been found to enhance the potential for primary water stress corrosion crack initiation during plant operation.

Figure 3:
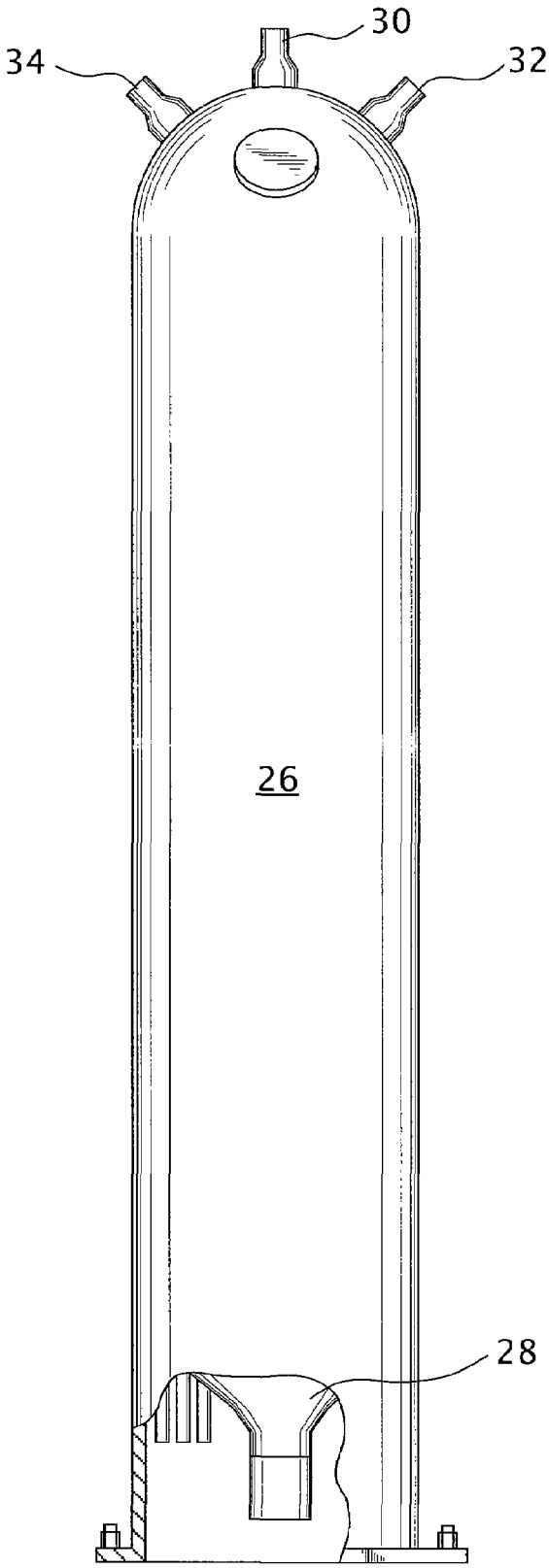
FIG. 3 is a planned view of a pressurized water reactor pressurizer vessel with a lower portion cut away to show the surge nozzle in the bottom head and the spray, safety and relief nozzles are shown in the top head.

FIG. 3 illustrates a pressurizer vessel 26 having a surge nozzle 28 at its lower end and spray nozzle 30, safety nozzle 32 and relief nozzle 34 extending from its hemispherical upper end. Reactor primary coolant water or steam generally circulates in or out of the vessel 26 through these nozzles.

Figure 4:
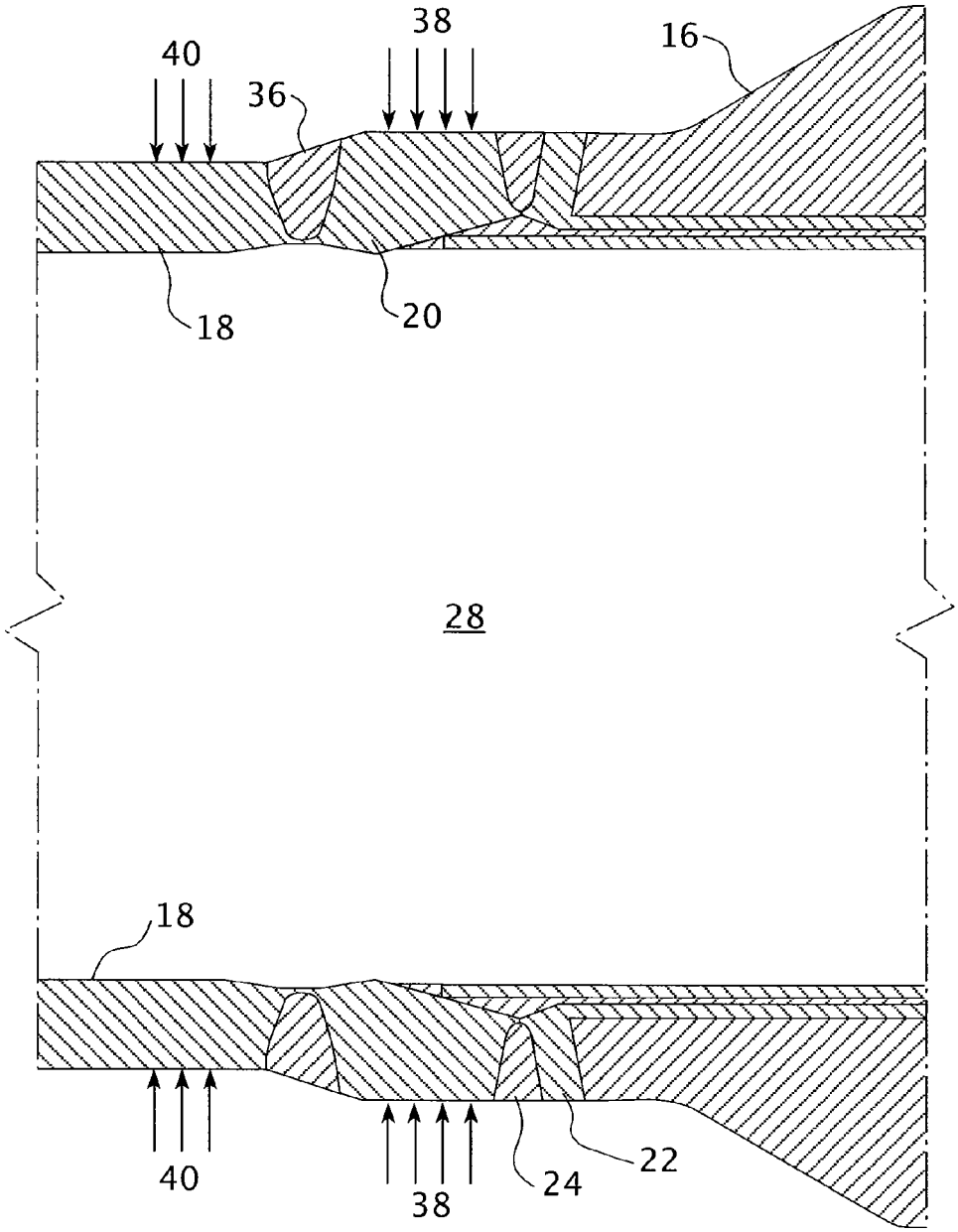
FIG. 4 is a cross-sectional view of a typical pressurizer surge nozzle end high nickel-chromium alloy weld buttering welded to a forged austenitic stainless steel safe-end.

FIG. 4 shows a schematic cross section of a typical surge nozzle configuration normally welded to the center of the bottom head of the pressurizer vessel 26.

Figure 5:
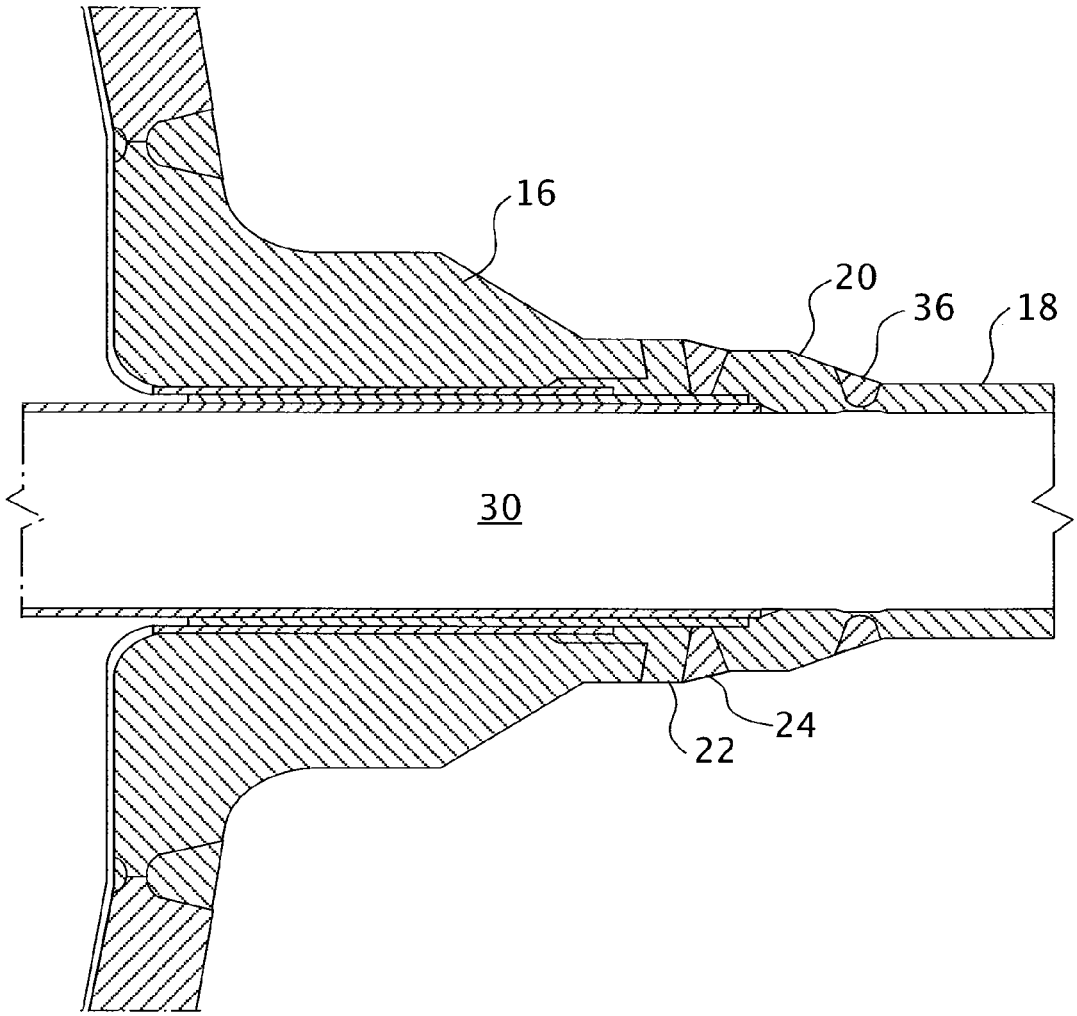
FIG. 5 is a schematic cross-sectional view of a typical pressurizer spray nozzle end high nickel-chromium alloy weld buttering welded to a forged austenitic stainless steel safe-end.

FIG. 5 shows a typical spray nozzle configuration 30 normally welded to the center of the upper head of the pressurizer vessel 26.

Figure 6:
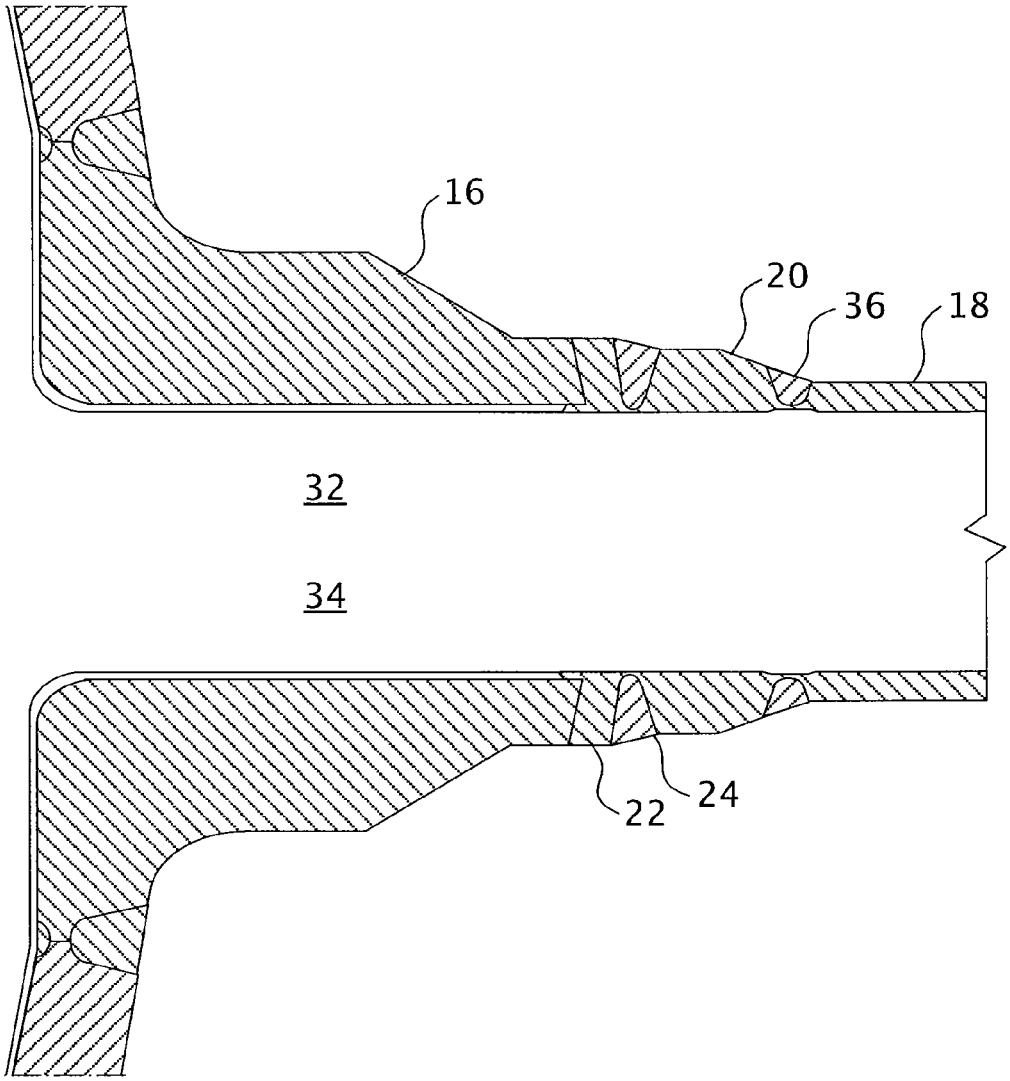
FIG. 6 is a schematic cross-sectional view of a typical pressurizer safety and relief nozzle end high nickel-chromium alloy weld buttering welded to a forged austenitic stainless steel safe-end.

FIG. 6 shows a typical safety or relief nozzle configuration 32, 34, mounted off-center on the upper head of the pressurizer vessel 26.

Although there are some slight differences in the configuration of the various nozzles illustrated in the FIGS. 2, 4, 5, and 6, those differences in configuration are insignificant in regard to this invention. Accordingly, like reference characters will be employed to identify the nozzle end 16 the buttered layers 22, the nozzle/safe-end weld 24, the safe-end 20, the safe-end to coolant piping weld 36 and the coolant piping 18 in the various figures.

To facilitate the subsequent field welding operation between the pressurizer surge, spray, safety and relief nozzle ends and the austenitic stainless steel coolant piping 18 a stainless steel transition piece or safe-end 20 is welded by the pressurizer vessel manufacturer to the low alloy steel forging end 16. The welding between the low-alloy-steel nozzle forging 16 and the stainless steel transition piece or safe-end 20 is made with high-nickel-chromium alloy welding materials in two steps. During the first step the low alloy steel nozzle end forging 16 is buttered by depositing a minimum of two layers 22 of high-nickel-alloy weld material using either coated consumable electrodes or bare filler material. Upon completion of the buttering operation, the nozzles are submitted together with the pressure vessel (10, 26) to a post-weld heat treatment to remove residual weld stresses and temper the low-alloy-steel nozzle heat-affected zone. The high-nickel-alloy buttered weld surface 22 is then machined to obtain a suitable weld chamfer geometry that is compatible with the matching weld chamfer on the austenitic stainless steel transition piece. The minimum thickness of the as-machine high-nickel-alloy weld buttering is typically 0.125" (0.3175 centimeters).

During the second step the buttered nozzle end 22 is welded to the austenitic stainless steel transition ring or safe-end 20 normally with high-nickel-alloy electrodes or bare filler wire. This last welded joint 24 is not submitted to a stress relieving post-weld heat treatment and therefore the inner part of the nozzle end high nickel-chromium alloy weld, including the adjacent high nickel-chromium alloy buttering 22, is left with residual tensile stresses.

In accordance with this invention, as shown in FIG. 4, when a controlled circumferential compressive load (38, 40) is applied either on the outer surface of the reactor vessel and pressurizer vessel nozzles austenitic stainless steel transition piece or safe-end 20, or on the austenitic stainless steel coolant pipe 18 or simultaneously on both, at a suitable distance from the high nickel chromium alloy weld joint 24, the residual weld stresses in the weld joint 24 and nearby nozzle end 16 are redistributed, so that the inner surface tensile stresses are replaced by permanent compressive stresses. The compressive stresses have their maximum value at the inner surface of the nozzle end 16, approximately in the center line of the high nickel-chromium alloy weld 24. The compressive stresses are maintained from the inside surface of the nozzle/safe end joint until approximately 50 percent of the weld thickness where the compressive stresses are gradually changed to tensile stresses, reaching their maximum level at the nozzle external surface; an area not susceptible to primary water stress corrosion cracking. The replacement of tensile stresses with compressive stresses in the inner surface of the high nickel-chromium alloy welds between the low-alloy nozzles 16 and the austenitic stainless steel transition rings or safe-ends 20 of the pressurized water reactor vessel inlet and outlet nozzles and of the pressurizer surge, spray, safety and relief nozzles, by the process described herein, will mitigate and prevent the potential occurrence of primary water stress corrosion cracking in the nozzle end welds 24 and butter 22.

A SPECIFIC EXAMPLE

Referring to FIG. 4, the surge nozzle 28 of a pressurized water reactor pressurizer vessel made of a low-alloy steel SA-508 C1.2 forging had been first buttered 22 and then welded to a SA-182-F 316L austenitic stainless steel safe-end 20 using high nickel-chromium alloy weld material such as electrodes of Inconel 182 or bare filler wire of Inconel 82. The welding operation resulted in the generation of high tensile stresses in the inner surface of the high nickel-chromium alloy weld 24 joining the low-alloy steel nozzle end 16 to the austenitic stainless steel safe-end 20 and adjacent forging materials. The magnitude of the residual weld stresses has been calculated using a finite element program to be in the order of 15,000 to 40,000 psi and no post-weld stress relieving heat treatment had been applied to the pressurizer surge nozzle end weld 24.

Figure 7B:
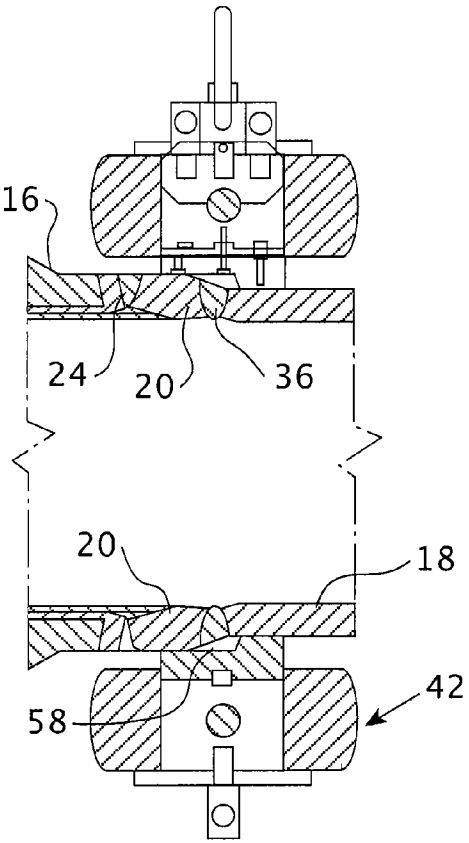
FIGS. 7A and 7B are schematic representations of a tool positioned to apply radial compressive forces simultaneously on both the safe-end and connecting coolant piping.
Figure 7A:
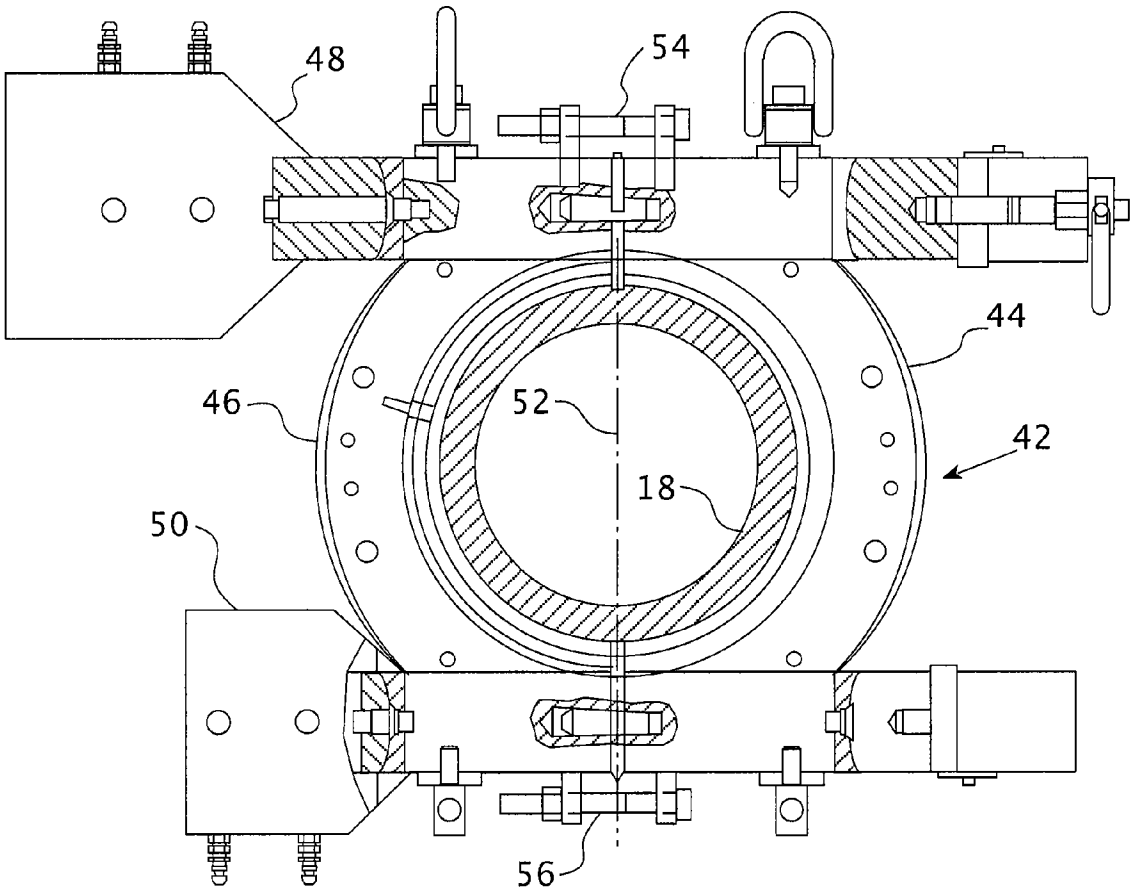

A radial compression load 38 was applied on the external surface of the transition piece 20 and a corresponding radial compression load 40 was applied on the external surface of the connecting coolant pipe 18 using special equipment such as the circular clamp 42 illustrated in FIG. 7A and 7B, to plastically squeeze and permanently deform the transition piece in the range of approximately 0.2% to about 3.0% and more preferably in the range of about 0.6% to about 2.5%.

The residual tensile weld stresses in the area where primary water stress corrosion cracking is likely to occur have been replaced by compressive stresses, calculated to be approximately minus 15,000 to minus 25,000 psi. The compressive stresses extend throughout approximately 50% of the weld thickness. Under this modified stress condition primary water stress corrosion cracking is unlikely to occur.

FIG. 7A is a front view of a circular clamp that can be used to impart the radial compressive load described above. FIG. 7B is a side view of a cross-section of the circular clamp and nozzle/safe end/coolant piping connection. The clamp is formed in two halves 44 and 46 and split along a central axis 52. The two halves are joined by side bolts 54 and 56 to circumscribe the safe-end 20 and coolant piping 18 to which the load is to be applied. The load is applied by the hydraulic cylinders 48 and 50 which force the two clamp halves 44 and 46 together to achieve the desired reduction in diameter. From the side view shown in FIG. 7B it can be seen that the split rings or clamp halves 44 and 46 contain a channel 58 which spans the weld between the safe-end 20 and the reactor coolant piping 18, applying the load on each segment, 18 and 20, without placing the load directly on the weld 36. The actual compression of the coolant pipe 18 and safe-end 20 at the mid-point at which the load is applied, may actually be greater than 3% so long as the permanent contraction, when the load is removed, is within the range of about 0.2% to 3.0%. Once the permanent contraction has been reached the load can be immediately removed. After the load is removed the diameter or the circumference can be measured to verify the permanent contraction is within the stated range. If it turns out that the contraction is not within the stated range the load can be reapplied until the desired permanent contraction is achieved. Shims can be placed between the two ring halves 44 and 46 to assure that the contraction does not exceed the stated range.

For purposes of the process defined and claimed herein, the following definitions will provide a better understanding thereof. "Weld metal" is the metal constituting the fused zone joining the ends of two adjacent pipe ends or fittings to each other. The "heat-affected zone" means that portion of the piping immediately adjacent to the weld metal wherein the temperature rise during welding affects the grain structure of the metal of the piping. In general, the axial length of the heat-affected zone does not exceed the weld thickness of the welded piping at the weld. The "adjacent base metal" is that portion of the piping immediately adjacent to the heat-affected zone extending axially from the heat-affected zone a distance not exceeding 2.0 $\sqrt{Dt}$, wherein t is the weld thickness of the piping and D is the outer diameter of the piping. "Residual welding stresses" are those stresses that remain in a weldment without external loading after the heat energy of welding has been dissipated. The plastic deformation induced in the metal by welding heat is the principal cause of residual stresses in weldments. "Weldments" include the weld metal, the heat-affected zone and, in some cases the adjacent base metal.

The mechanical means employed for applying the desired radial load on a section of the piping elements described herein is not critical to the invention, provided such means are sufficient to obtain and control the defined permanent reduction in the diameter of the piping elements to which the load is applied. For example, the mechanical means can also comprise a pair of split rings whose inner surfaces are contoured to the outside surface of the section of the steel piping element that is to be contracted, and means to force the rings onto the section of the steel piping element to contract the same. The maximum movement of the split ring halves toward each other can be limited using shims inserted at the split locations. The inner surfaces of the split rings can be lined with a crushable insert, for example, made of an indented or waffled steel sheet, which adjusts to the actual cross-section of the steel piping element. A means for imposing the desired contraction can be obtained for example, by providing the adjacent ends of the split rings with aligned, tangential openings and bolts disposed in said openings, by means of which the halves of the split rings can be forced together toward each other. The hydraulic cylinders 48 and 50, described above, for joining the rings together is a more practical alternative, especially for large piping members such as those found in pressurized water reactor plants.

While specific embodiments of the invention have been described in detail, it will be appreciated by those skilled in the art that various modifications and/or alternatives to those details could be developed in light of the overall teachings of the disclosure. Accordingly, the particular embodiments disclosed are meant to be illustrative only and not limiting as to the scope of the invention, which is to be given the full breath of the appended claims and any and all equivalents thereof.

What is claimed is:

1. A process for removing the residual tensile welding stresses in an inner layer of a weld metal and a heat-affected zone of a coupling between a pressurized water reactor pressure vessel nozzle and an intermediate transition pipe that spans between the pressure vessel nozzle and a primary coolant piping section, where the nozzle and the primary coolant piping section have each been butt-welded end-to-end to different ends of the intermediate transition pipe by means of circumferential welds, which process comprises:

mechanically introducing circumferential compressive stresses in a first section on said transition pipe spaced from the weld between the pressure vessel nozzle and the intermediate transition pipe by applying a radial load inwardly on said first section; and mechanically introducing circumferential compressive stresses in a second section on the primary coolant piping section by applying a radial load inwardly on said second section;

wherein the amount of said radial load being applied on said first and second sections is sufficient to permanently reduce the outside diameter at a midplane of the first and second sections in a range of about 0.2 to about 3.0 percent, the percent of permanent contraction at said midplane of said first and second sections upon which said radial loads are applied being greater than the permanent contraction at the midplane of the weld between the pressure vessel nozzle and the intermediate transition pipe, said inner layer at the weld location between the pressure vessel nozzle and the intermediate transition pipe assuming a concave configuration as a result of said application of said radial loads.

2. The process of claim 1 wherein the amount of said radial load being applied on said first and second sections being sufficient to permanently reduce the outside diameter at a midplane of the first and second sections in a range of about 0.6to about 2.5percent.

3. The process of claim 1 wherein the radial loads applied to the first and second sections are applied substantially simultaneously.

4. The process of claim 1 including the steps of:

releasing the radial loads on said first and second sections;

measuring the diameter or circumference of the midplane of first and second sections; and if a measurement obtained from the measuring step does not identify an about 0.2to about 3.0percent permanent contraction at either or both the midplane of the first and second sections then reapplying the radial load at either or both the first and second sections that has not demonstrated and about 0.2to about 3.0percent permanent contraction.

5. The process of claim 1 wherein the pressure vessel nozzle is made of carbon steel and the coolant piping and the intermediate transition pipe are made of stainless steel.

6. The process of claim 5 wherein the intermediate transition pipe is welded to the pressure vessel nozzle using a high nickel-chromium alloy weld material.

7. The process of claim 6 wherein the weld material is selected from the group of Inconel 182 and Inconel 82.

8. The process of claim 6 where in the process is applied to stop propagation and growth of pre-existing axial and circumferential Primary Water Stress Corrosion Cracking.

9. The process of claim 1 including the step of applying the process at a nuclear pressurized water reactor power plant during construction or during an outage.

* * * * *